United States Patent [19]

Lowstuter

[11] 4,433,720

[45] Feb. 28, 1984

[54] EARTH TEMPERED BUILDING DESIGN SYSTEM

[76] Inventor: W. Robert Lowstuter, 8718 Orient Way, NE., St. Petersburg, Fla. 33702

[21] Appl. No.: 257,191

[22] Filed: Apr. 24, 1981

[51] Int. Cl.[2] ..... E02D 27/32

[52] U.S. Cl. ..... 52/169.11; 165/45; 62/260

[58] Field of Search ..... 52/293, 169.5, 169.11, 52/274; 165/45; 62/260

[56] References Cited

U.S. PATENT DOCUMENTS

| | | | |
|---|---|---|---|
| 2,141,397 | 12/1938 | Locke | 52/274 |
| 2,291,548 | 7/1942 | Gilman | 165/45 |
| 2,428,876 | 10/1947 | Hawkins | 165/45 |
| 2,860,493 | 11/1958 | Capps et al. | 165/45 |

*Primary Examiner*—James L. Ridgill, Jr.
*Attorney, Agent, or Firm*—Frijouf, Rust & Pyle

[57] ABSTRACT

A section of a cement block building, usually a dwelling place, is illustrated with six versions of the means to carry out the basic concept.

At some distance below the earth's surface, the temperature of the earth structure is substantially constant. This statement is in the context of normal building structure erected by man. The known increase in temperature at great depths is excluded from the operation of this invention.

The depth to which one must go to experience constant year around temperatures will vary with location and this invention is more useful in those areas which do not experience extreme temperature variations, but which do require heat and cooling for best dwelling comfort.

The earth below the surface is a huge heat sink, capable of absorbing unlimited heat energy from a higher source, or giving energy to a lower energy level area.

Thus, this invention provides a thermal transport to and from the earth's constant level depth, and surrounds a dwelling with a grid to cause the building interior to proximate the earth temperature, which is warmer than the winter cold and cooler than summer heat.

16 Claims, 10 Drawing Figures

10
11
13
14
16
12
20
18
22

24
22

26

29
28

34
32
31
35

16B
50
16A

35

EARTH TEMPERED BUILDING DESIGN SYSTEM

BACKGROUND OF THE INVENTION

1. Field of the Invention

Passive comfort conditioning of a building with or without mechanical supplement, wherein thermal energy is intercepted and shunted to earth in summer, and supplied from earth in cold periods.

2. Description of the Prior Art

Geothermal energy is usually through of as tapping very hot substrata of the earth to produce steam for generating power. However, it has long been recognized that the temperature of the earth below the immediate top surface areas, remains relatively constant throughout the entire year in the major portion of the earth's surface. This stable temperature has been used to reduce the comfort conditioning of dwelling places by partially building into the earth, much in the manner of early cave dwellings.

It is becoming increasingly popular to use heat pump air conditioning systems in order to extract heat from the atmosphere in colder seasons and use that heat to warm the interior of the dwelling residence. That system has been enhanced by using the geothermal principle to extract heat energy from the subsoil during heating season and to absorb excess heat during the refrigeration ccycle of heat pump use. This is accomplished sometimes by extending the refrigerant through tubes into the subsoil, but more usually by drawing water from wells to flow through heat exchangers of the system at surface level.

The passive system response to geothermal energy appears to be limited strictly to the prevention of heat flow in colder climates wherein foundations are protected against earth freeze below the foundation. See for example U.S. Pat. No. 3,561,175.

U.S. Pat. No. 4,127,973 teaches a specific arrangement of the well known heat sink principle wherein an area below the slab of a house is filled with gravel to a depth below the frost line to act as a constant heat sink for circulated air in the house. Insulation prevents contact of the slab of the house with the foundation.

A still further example of insulation from the earth is shown by U.S. Pat. No. 3,798,858. This and the former references all have their positive purposes, but insofar as the background of this invention is concerned it indicates the effort to prevent communication of the building floor and walls with the geothermal store below the surface of the earth.

It is an object of this invention to provide earth tempering for a building without the necessity of building under ground or use of an earth bern.

The object of earth tempering is to enhance the energy efficiency of a building.

It is also an object of this invention to transport thermal energy from earth to provide energy to a building during a time when ambient temperature is lower than desired building interior temperature.

Yet another object of this invention is to provide earth tempering in a simple form that may be incorporated into new construction, but which is capable of being retrofitted to an existing building, even by an inexperienced owner.

Other objects and a fuller understanding of this invention may be had by referring to the summary of the invention, the description and the claims, taken in conjunction with the accompanying drawings.

SUMMARY OF THE INVENTION

An integrated system of insulation and thermal energy transport which utilizes the heat sink properties of the earth mass and principles of thermal energy flow to remove excess heat from concrete buildings in summar and to add needed heat in winter. In new construction the thermal energy transport consists of heat conducting material built into the structure walls and extending into the earth. To retrofit an existing structure the thermal conducting material extends from the ground up the sides of the walls. All surfaces are then encased in exterior insulation to isolate the structure from the effects of ambient and near ambient air and ground temperatures.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should be realized by those skilled in the art that such equivalent constructions do not depart from the spirit and scope of the invention as set forth in the apended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figures 1, 2, 3, 4, 5, 9, 10:
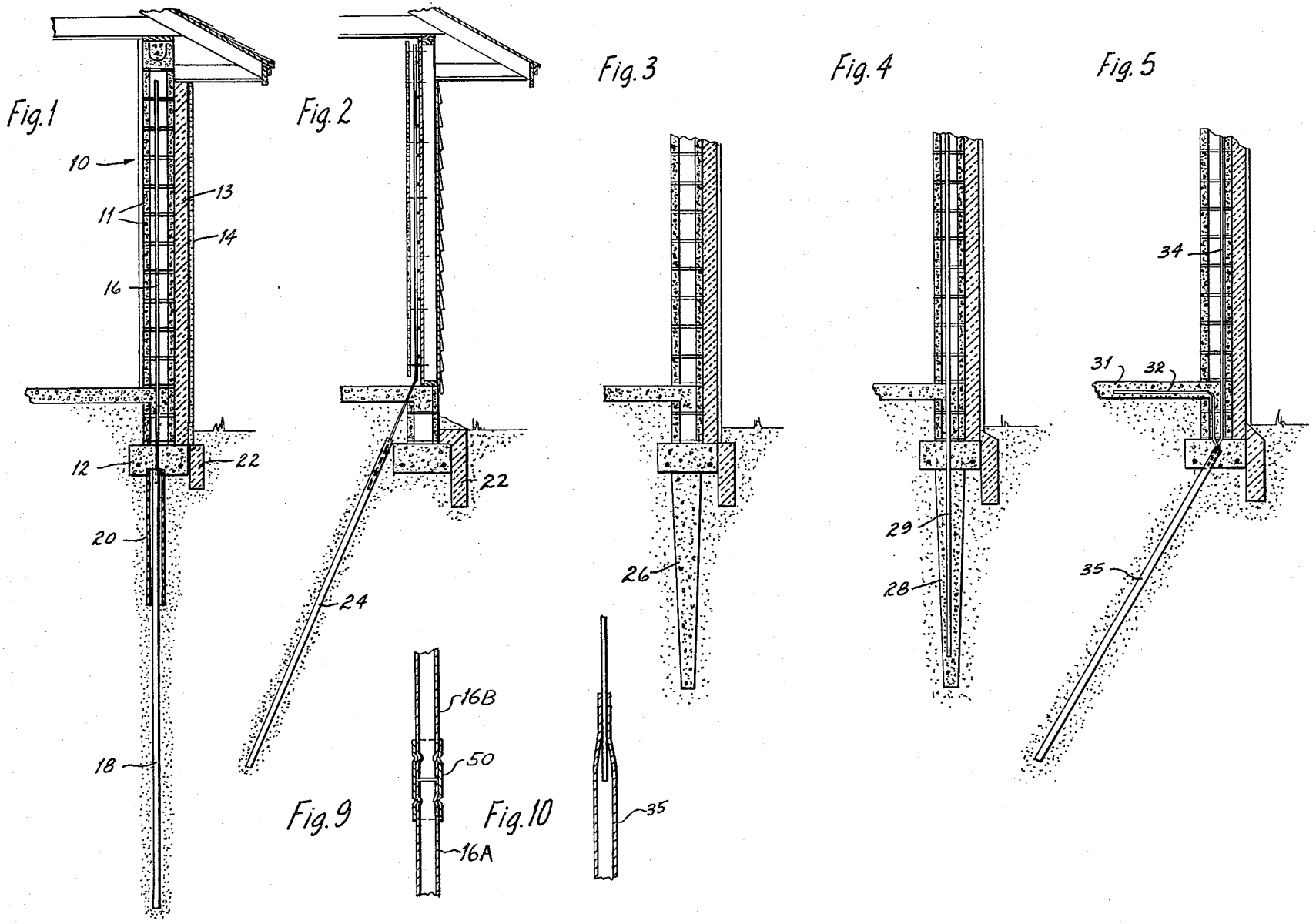
FIG. 1 is a section through a concrete block wall of a finished dwelling, with a thermal probe extending into the earth below the wall, and a section of vertical insulation material exterior of the foundation footer to divert temperature variations resultant from seasonal ambient temperature changes.
FIG. 2 is a wall section of frame construction with the heat sink probe projecting at an angle under the building.
FIG. 3 is a fragmentary wall section with a concrete pillar as a thermal probe, with no conductive metal core.
FIG. 4 is a wall section with a concrete pillar probe and metal core extending essentially to the limits of the wall and the probe.
FIG. 5 illustrates the use of a thermal conducting core from both the slab and the wall joined to a metal thermal probe into the supporting earth.
FIG. 9 illustrates the joining of short grid rods to assemble a grid.
FIG. 10 illustrates a junction of a rod and tube.

The concept of this invention is to use the heat sink properties of the ground to temper the interior environment of the typical concrete block home. The first step is to isolate the building structure from the above ground environment by an exterior insulation of high R value. High insulation material materially reduces absorbing or radiating of heat energy to the air space around the building. Also, this isolation allows the structure to conduct heat energy between the earth heat sink and the interior of the house. Concrete has good heat conductance, and because the walls and floor are isolated from the exterior environment, they will tend to maintain a temperature versus time curve close to the ground temperature. The ceiling or roof structure also needs a high R value insulation to minimize loss or gain of heat energy. The theory projects that auxillary heating or cooling should be necessary primarily for infiltration, energy gains or losses through window and door areas, and heat generated by household appliances and activities.

In an experimental use development to determine the feasibility of the present invention, a 28'×50' building in St. Petersburg, Florida was used as the experimental base. This building has a solid, poured concrete footer which extends 4 inches beyond the block line. This footer is 8 inches to 10 inches below ground level. On the 28 foot north side, the footer was cleaned off and a line of 16 inch high concrete slabs 8 inches by 16 inches by 2 inches was mortared 2 and 5/8 inches from the wall. Pressure treated 1 inch by 2 inch pine was cut to 6 inch pieces and fastened to pressure treated pine 2 by 4 by 91 inch pieces with heavy galvanized nails. The 2 by 4's were fastened to the block walls at 2 foot intervals with cut nails. The St. Petersburg building inspector checked and passed the furring.

Holes were drilled in the concrete block 1" deep with a ⅛" tungsten bit. Temperature sensors were fastened in the holes with clear silicone rubber sealant. Wires were then run to a multiple line temperature display set up in the garage. The sensors were placed at four locations in a vertical line.

1. Under the footer
2. #2 block above footer
3. #5 block above footer
4. #9 block above footer Reference sensors were placed on the garage wall.

Eighteen inch wide heavy duty aluminum foil was fastened to the 2×4's in horizontal rows starting at the bottom. A 4'×8'×½" piece of plywood sanded one side was then fastened to the 2×4's with double headed nails with the 8' side horizontal. Two lb/cuft polyurethane was then foamed behind the concrete base and the plywood form. After the foaming reaction was completed the plywood panel was removed to the next position down the wall. The aluminum foil acts as parting agent for the plywood. The foam had covered the sensor on the #2 block but did not quite reach the #5 block sensor. Over a period of two weeks the #2 sensor has varied no more than 2 degrees from the #1 sensor which has remained constant at 72° F. Morning temperatures were as low as 55° F. and afternoon temperatures were as high as 84° F. The #2 sensor was influenced by the constant ground temperature beneath it and by the variable temperature of the block wall above it. This single experiment does show that it is possible to maintain an exterior wall at human comfort temperature levels by ground heat conduction through a concrete wall.

In order to fully disclose the invention and the method of its use, drawings have been provided to show acceptable variations and adaptations of the invention.

In FIG. 1, the building wall is indicated by the reference character 10. Wall 10 is composed primarily of concrete blocks 11 seated upon a conventional footer 12.

Almost any approved exterior finish can be used. The polyurethane layer referred to above is indicated by reference character 13. This type of foam in regular stud wall building construction has been finished in the Florida area with hard board panel. Stucco is popular in Florida, and that surface is indicated by reference character 14. The stucco is used by first roughening the polyurethane surface.

A completed building will require a finite number of thermalconductors to act as a thermal intercepter for a complete building. However, the invention can be reduced to its basic elements at each finite element of the construction may act as a individual in cooperation with other elements. Accordingly, at least one thermal conductor is placed in contact with the building wall. That thermal conductor must have a thermal conductivity greater than the wall, and then at least one thermal probe is extended into the earth adjacent the building wall to a depth wherein the earth exhibits no substantial seasonal temperature variation for the location of the building. The thermal conductor is joined to the probe in order to transport thermal energy to or from the earth.

In actual construction, a grid 16 is employed. It has been determined that the grid may simply consist of a plurality of parallel conductive rods, or, as more conventionally conceived, the grid may consist of non parallel thermal conductors, a rectangular network, or a series of rods in a finite pattern in any direction. The possibility even exists of using a solid plate, althrough such a construction would be far more expensive than necessary.

Because the conductors are closely associated with a wall, and preferably a concrete block or other ceramic material wall, it is desirable to place the conductors in a close enough association that the slower conducting ceramic material may be in reasonably close proximity to the faster conducting grid member.

Figure 8:
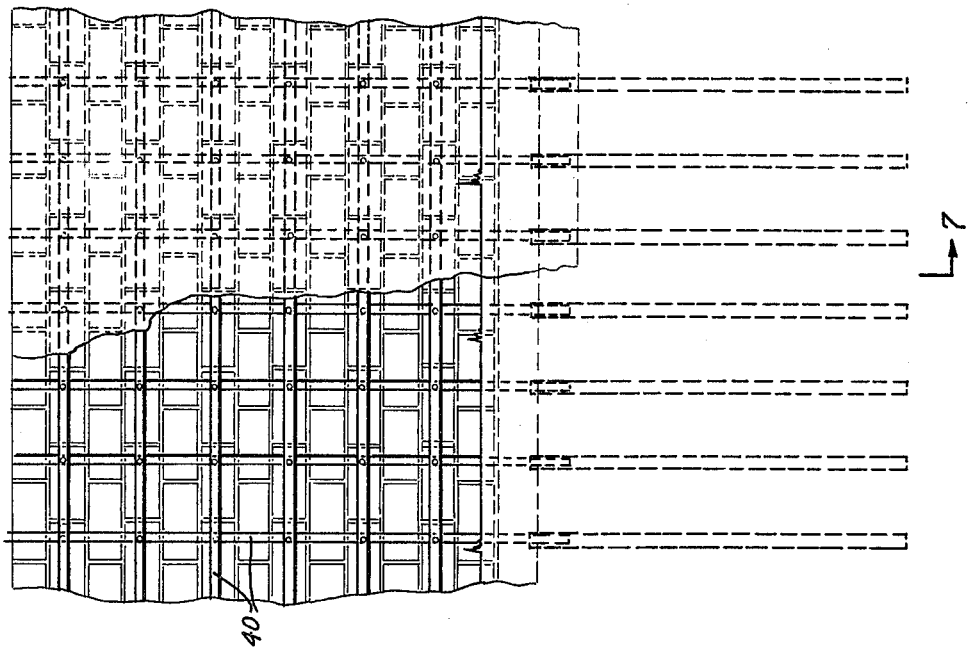
FIG. 8 is a cross-linked retrofit structure with the grid area covering the exterior wall.
Figure 6:
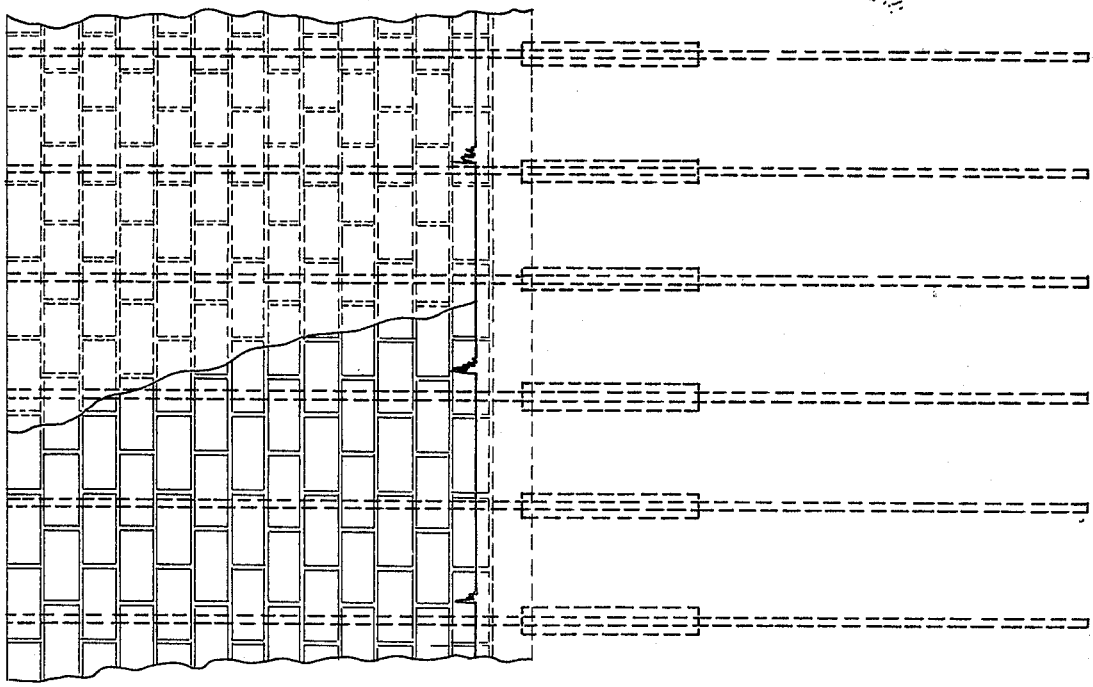
FIG. 6 is a section of a block building wall with a series of thermal interceptors and probes.

The grid is connected to at least one probe, but preferably a series of probes as suggested in FIGS. 6 and 8 will supply the proper heat conductivity.

The probes 18 extend through the area which exhibits seasonal temperature variation. In freezing climates, the foundation of the building must be placed below the frost line, but in tropical or sub tropical areas the foundation depth requirements is far less. Nevertheless, in sub tropical or tropical areas, there is a variation in the soil temperature from the surface to a finite depth according to the location of the building. In order to provide greater efficiency, it is desirable that a sheath 20 be placed around the conductive probe 18 to a depth below the depth exhibiting the seasonal temperature variation. Thus, the thermal transport will be greater to the grid without unnecessary tempering of soil under the footer 12.

The prior art has taught the use of insulation materials for deflecting the frost line in northern climates away from footers of the building, and such a deflector 22 is shown in the several Figures of the drawings. Such a deflector is effective in isolating the building structure from environmental influence.

It has been found that superior results will be obtained by sending the probe at an angle under the building and that situation is illustrated by the angular probe 24 in FIG. 2. With the building shading and protecting the earth, the temperature variation under the building is far less than the temperature variation under the exposed soil exterior of the building. The stability area extends essentially to the slab of the house in such situations. The balance of the disclosure illustrates probes descending at an angle into the earth, for simplicity of illustration and understanding, but the vertical extension of the probe 18 is considered to be an alternative that may be employed where the preferred angle extension is not feasible.

FIG. 3 illustrates the use of a concrete probe 26. Concrete or other ceramic material has a reasonable conductivity for thermal energy, although slower than metals. Nevertheless, by extending a concrete probe into the stable area of the earth, a wall seated thereon, with or without a metal grid, will have earth tempering qualities.

However, when using a concrete probe, it is preferable to use a metal grid and to extend that grid into the concrete probe. Such a composite probe is indicated in FIG. 4 by the reference character 28. Probe 28 has a conductor core 29 which extends up into the wall grid, or may be connected thereto as a separate unit.

A further variation is illustrated in FIG. 5 wherein the additional tempering quality is accomplished in the slab of the building by the provision of a conductor system 32 in a slab 31 and that system 32 joined with a grid system 34 to a probe 35.

Figure 7:
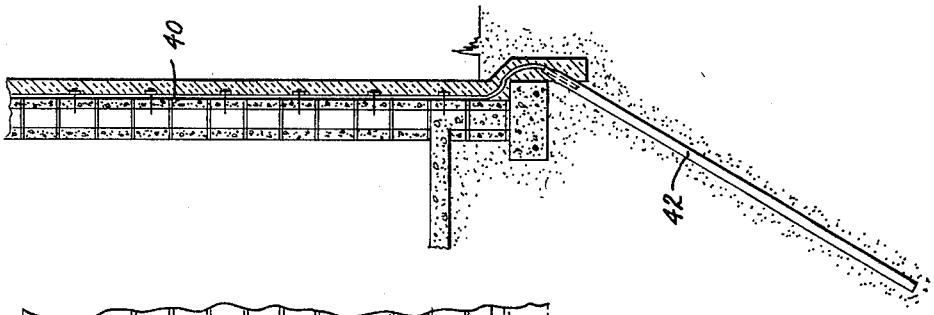
FIG. 7 is a section through the wall of FIG. 8.

There are a vast number of suitable houses, particularly in the sub tropical areas such as Florida in the United States, which are built of concrete block for the various climate and insect control reasons. These many houses may benefit from this invention by the provision of an exterior grid 40 as shown in FIGS. 7 and 8. The grid 40 is easily and conveniently attached to the surface of a concrete block wall, as well as other types of walls, as suggested in the FIGS. 7 and 8. In this construction the only difference is that the grid is on the exterior wall rather than built into the wall itself. This exterior grid may be applied by an experienced contractor, but is so simple in its construction, and operation, that the home owner is capable of installing the system without professional help.

In the FIG. 7, probe 42 is extended at an angle under the building to illustrate the capability of employing this system whether in an original or retrofit construction.

In the testing of this invention, it was soon apparent that installation of a single length of grid rod 16 into a new block wall was impractical. Each block would have to be lifted to the full height of the rod, and lowered into position. Therefore, the rod is a composite and joined by a coupling, such as coupling 50, as illustrated in FIG. 9. Short pieces 16A and 16B of any number are thus joined to produce the desired height piece by piece as the wall is erected.

Also, flt rod stock may be used as the grid material, and joined to a tube probe 35 by crimp joining, as illustrated in FIG. 10.

Now that the invention has been described, what is claimed is:

1. A thermal interceptor for building climate modification, wherein a building wall defines a segment of an enclosure, the interceptor comprising:

at least one thermal conductor extending at least partially along the height of the wall;

said thermal conductor having a thermal conductivity greater than the wall;

said thermal conductor being in thermal contact with the wall;

at least one thermal probe extending into the earth adjacent the building wall to a depth wherein the earth exhibits a substantially constant temperature for the location of the building; and means for directly connecting said thermal conductor to said thermal probe enabling the natural flow of heat between said thermal conductor and said thermal probe to maintain the temperature of the building commensurate with said substantially constant temperature.

2. A thermal interceptor for building climate modification, wherein a building wall defines a segment of an enclosure, the interceptor comprising:

a thermal conductor grid in thermal contact with and extending at least partially along the height of the building wall;

said thermal conductor grid having a thermal conductivity greater than the building wall;

a plurality of thermal probes extending into the earth adjacent the building wall to a depth wherein the earth exhibits a substantially constant temperature for the location of the building; and means for directly connecting said thermal conductor grid to said plurality of thermal probes enabling the natural flow of heat between said thermal conductor grid and said plurality of thermal probes to maintain the temperature of the building commensurate with said substantially constant temperature.

3. A thermal interceptor for building climate modification, as defined in claim 2, wherein said thermal conductor grid is a series of parallel bars.

4. A thermal interceptor for building climate modification as defined in claim 2, wherein said thermal conductor grid is a pattern of interconnected conductors.

5. A thermal interceptor for building climate modification as defined in claim 2, wherein said thermal conductor grid is fastened to the exterior of a the wall.

6. A thermal interceptor for building climate modification as defined in claim 2, wherein the grid is encased in an inorganic plaster.

7. A thermal interceptor for building climate modification as defined in claim 2, wherein said thermal conductor grid is encased in an inorganic plaster of ceramic material.

8. A thermal interceptor for building climate modification as defined in claim 2, wherein each of said plurality of thermal probes is a metal shaft.

9. A thermal interceptor for building climate modification as defined in claim 2, wherein each of said plurality of thermal probes is a metal shaft having a thermal insulating sheath over a portion thereof in the upper reaches of the earth.

10. A thermal interceptor for building climate modification as defined in claim 2, wherein a thermal deflector extends laterally of the wall foundation to deflect the thermal variation pattern away from said plurality of thermal probes.

11. A thermal interceptor for building climate modification as defined in claim 2, wherein each of said plurality of thermal probes is a cementitious pillar.

12. A thermal interceptor for building climate modification as defined in claim 2, wherein each of said plurality of thermal probes is a cementitious pillar extension of the wall foundation.

13. A thermal interceptor for building climate modification as defined in claim 2, wherein each of said plurality of thermal probes is a cementitious pillar with a metal conductor core.

14. A thermal interceptor for building climate modification as defined in claim 2, wherein the building has a slab floor with a thermal conductor system therein directly connected to said plurality of thermal probes and to said thermal conductor grid.

15. A thermal interceptor for building climate modification as defined in claim 2, wherein said plurality of thermal probes extend at an angle under the building to the area which is temperature stabilized by the building acting as a shield from the sun and ambient air.

16. A thermal interceptor for building climate modification, wherein a concrete block building wall defines a segment of an enclosure, the interceptor comprising:

a thermal conductor grid of composite rods disposed within the wall;

said rods having a thermal conductivity greater than the wall;

a plurality of thermal probes spaced along the base of the wall and extending into the earth to a depth below a point wherein the earth exhibits substantial temperature variation, a distance at least as great as the depth of the frost line for the geographical location of the building;

means for directly connecting said thermal conductor grid to said plurality of thermal probes enabling the natural flow of heat between said thermal conductor grid and said plurality of thermal probes to maintain the temperature of the building commensurate with the temperature of the earth at a depth below a point wherein the earth exhibits substantial temperature variation;

a thermal sheath around each of said plurality of thermal probes to a depth exhibiting major seasonal temperature variations; and an insulating coating over the exterior surface of the wall for increasing the temperature gradient between said thermal conductor grid and ambient air and direct radiation energy sources.

* * * * *

UNITED STATES PATENT AND TRADEMARK OFFICE

CERTIFICATE OF CORRECTION

PATENT NO. : 4,433,720

DATED : February 28, 1984

INVENTOR(S) : W. Robert Lowstuter

It is certified that error appears in the above-identified patent and that said Letters Patent are hereby corrected as shown below:

Col. 1, line 12, "through" should read --thought--.

Col. 1, line 29, "ccycle" should read --cycle--.

Col. 2, line 8, "summar" should read --summer--.

Col. 2, line 33, "apended" should read --appended--.

Col. 5, line 64, "flt" should read --flat--.

Col. 6, line 47, delete [a].

Col. 6, line 49, delete [the] and insert --said thermal conductor--.

Signed and Sealed this

*Fifth* Day of *June 1984*

[SEAL]

*Attest:*

GERALD J. MOSSINGHOFF

*Attesting Officer*

*Commissioner of Patents and Trademarks*